US010327575B2

(12) United States Patent
Irestahl et al.

(10) Patent No.: US 10,327,575 B2
(45) Date of Patent: Jun. 25, 2019

(54) GARMENT HANGER AND A SPRING FOR USE THEREIN

(71) Applicant: PETTERSSONS TRADING SWEDEN AB, Hillerstorp (SE)

(72) Inventors: Hans Irestahl, Hillerstorp (SE); Huan Yang, Hillerstorp (SE)

(73) Assignee: PETTERSSONS TRADING SWEDEN AB (SE)

( * ) Notice: Subject to any disclaimer, the term of this patent is extended or adjusted under 35 U.S.C. 154(b) by 3 days.

(21) Appl. No.: 15/513,201

(22) PCT Filed: Aug. 20, 2015

(86) PCT No.: PCT/IB2015/056324

§ 371 (c)(1),
(2) Date: Mar. 22, 2017

(87) PCT Pub. No.: WO2016/027248

PCT Pub. Date: Feb. 25, 2016

(65) Prior Publication Data

US 2017/0303719 A1 Oct. 26, 2017

(30) Foreign Application Priority Data

Aug. 22, 2014 (GB) ..... 1414991.8

(51) Int. Cl.
*A47G 25/48* (2006.01)

(52) U.S. Cl.
CPC ..... *A47G 25/483* (2013.01); *A47G 25/48* (2013.01)

(58) Field of Classification Search
CPC ..... A47G 25/48–25/487; A41D 27/22
USPC ..... D8/394, 395, 368; D6/323, 325–328
See application file for complete search history.

(56) References Cited

U.S. PATENT DOCUMENTS 1,684,721 A * 9/1928 Wood ..... D06F 55/00 15/154
2,523,780 A * 9/1950 Rodriguez ..... D06F 55/00 24/562
2,795,834 A * 6/1957 Szoke ..... A47G 29/08 248/113
3,103,727 A * 9/1963 Carr ..... D06F 55/00 24/565

(Continued)

FOREIGN PATENT DOCUMENTS

CA 2110231 A1 6/1994
DE 9204429 U1 6/1992
GB 2471332 A 12/2010

OTHER PUBLICATIONS

International Search Report for corresponding PCT/IB2015/056324, dated Nov. 20, 2015. WO.

*Primary Examiner* — Ismael Izaguirre
(74) *Attorney, Agent, or Firm* — The Belles Group, P.C.

(57) ABSTRACT

A spring for use in a garment hanger is disclosed. The hanger is of the type that includes a hook and a body with clips at either end of the arms of the body. The clips include a pair of clip portions between which the garment is clamped under the biasing for of a spring. The spring is generally U-shaped and has convex ribs both on the inner and outer services of its curvature. The ribs are located adjacent each other so that they form a sine-wave-like cross-section and are of sufficient depth that in their formation they causes the sides of the spring adjacent the ribs to be drawn inwards.

13 Claims, 4 Drawing Sheets

(56) References Cited

U.S. PATENT DOCUMENTS

| | | | | | |
|---|---|---|---|---|---|
| 3,950,829 | A | * | 4/1976 | Cohen | D06F 55/02 211/124 |
| 4,919,682 | A | * | 4/1990 | Bellazzi | F16L 33/035 24/20 EE |
| 5,241,728 | A | * | 9/1993 | Hunter | A47G 25/485 24/511 |
| D400,718 | S | * | 11/1998 | Bortolus | D6/328 |
| 6,418,595 | B1 | * | 7/2002 | Shih | A47G 25/483 223/85 |
| D636,293 | S | * | 4/2011 | Dolce | D11/222 |

* cited by examiner

GARMENT HANGER AND A SPRING FOR USE THEREIN

CROSS-REFERENCE TO RELATED PATENT APPLICATIONS

The present application is a U.S. national stage entry under 35 U.S.C. § 371 of Patent Cooperation Treaty Patent Application No. PCT/IB2015/056324, filed Aug. 20, 2015, which claims priority to GB 1414991.8, filed Aug. 22, 2014, the entireties of which are incorporated herein by reference.

The present invention relates to a garment hanger and to a spring for the use therein, and relates particularly, but not exclusively, to hangers with clips having a sliding spring release mechanism.

In the field of garment hangers it is well known to provide a hanger with one or more, generally two, clips which are used to clamp a garment into engagement with the hanger. Typically these hangers are used to grip trousers and skirts by the waistband of the garment.

An example of such a hanger is shown in FIG. 1, from which it can be seen that the hanger 10 includes a suspension device, in the form of a hook 12 and a body portion 14 which is connected to the hook 12. The body 14 is formed including a pair of arms which extend horizontally and terminate in a pair of clips 16. The operation of the clips 16 is demonstrated in FIGS. 2 to 4, from which it can be seen, in particular in FIG. 4, that the clip 16 is formed from two clip portions 18 and 20 and a spring 22. In a clamping position, as shown in FIG. 2, the spring 22 acts to clamp the clip portions 18 and 20 into engagement with each other to hold a garment (not shown) therebetween. To release the garment, the spring 22 is moved upwards (into the position shown in FIG. 3) and the clip portions 18 and 20 are then free to move and release the garment. In the example shown in FIGS. 1 to 4, the clip portions 18 and 20 are formed as a single component with a live hinge connecting them. However, other examples of hangers of this type are known in which the clip portions are separately formed from each other or separately from the hanger body.

The metal components, and in particular the clips, account for a significant proportion of the total cost of producing a hanger. Furthermore, the metal components contribute significantly to the total weight of the hanger and therefore to associated costs such as transportation. As a result, any reduction in the amount of metal used to produce the spring has significant benefits to the manufacture and supply of the garment hanger. As a result, it is well known to introduce stiffening ribs into the clips as this allows a reduction in the amount of material used to obtain the same biasing strength of the spring.

An example of a spring 22 of the prior art is shown in FIGS. 5 to 7. In these figures it can be seen that five ribs, indicated at 24, 26, 28, 30 and 32 are used to stiffen the spring. However, it remains desirable to further reduce the material used in the manufacture of these springs for use in garment hangers.

Preferred embodiments of the present invention seek to overcome the above described disadvantages of the prior art. It is an object of the invention to provide improvements in or relating to generally U-shaped springs for clips, used in garment hangers or the like, in relation to the stiffness and resilient operating characteristics, having regard to the gauge of metal or the like used in the construction thereof.

According to an aspect of the present invention there is provided a garment hanger comprising:— at least one suspension device for suspending the hanger from a support;

a body connected to said suspension device; and at least one clip connected to said body for retaining a garment, the or each clip comprising a pair of clip portions, between which the garment is clamped, and at least one generally U-shaped spring for biasing said clamping portions, wherein at least one said spring comprises convex ribs both on the inner and outer services of the curvature of said U of said spring.

By providing a spring in the garment hanger which has convex ribs on both the inner and outer surfaces of the curvature of the spring, the advantage is provided that the gauge of metal from which the spring is produced can be reduced and at the same time the biasing force of the spring has surprisingly increased. In experimental results, the use of this design of spring has allowed the use of a gauge of steel that is 20% less thick and yet provides 20% more biasing force than the spring of the prior art example. As a result, the overall cost of the hanger can be reduced both in the quantity of material used and secondary costs, such as transportation, resulting from the weight.

In a preferred embodiment one of said ribs on said inner surface is adjacent one of said ribs on said outer surface.

By providing one of the ribs on one surface adjacent another rib on the other surface the advantage is provided that the ribs are connected with each other. This in turn enhances the effect of each of the ribs further increasing the biasing force provided by the spring.

In another preferred embodiment the ribs together form a substantially sine-wave-like cross-section.

By creating a substantially sine-wave-like cross-section this provides the advantage of connecting all of the ribs together and this results in the maximum enhancement of the effect of each of the ribs, in turn producing the maximum biasing force.

In a further preferred embodiment the formation of said ribs causes the sides of said spring adjacent said ribs to be drawn inwards.

By forming the ribs in such a way that the edges of the spring adjacent the ribs are drawn inwards the material forming the ribs is not stretched but is simply deformed. In the prior art the opposing edges of the spring are equidistant along the length of the spring irrespective of the presence or absence of the ribs. As a result, the creation of the ribs, in the prior art spring, requires the partial stretching of the material from which the spring is formed. In contrast in the present invention, by allowing the edges of the spring to be drawn inward the thickness of the material forming the spring remains consistent (as measured tangentially to the curve of any rib) across the whole width of the spring across each rib. This in turn ensures the maximum biasing strength is created within the spring.

In a preferred embodiment the spring comprises a plurality of ribs on one of said inner and outer surfaces and a plurality of ribs on the other of said inner and outer surfaces.

In another preferred embodiment the spring comprises at least three ribs on one of said inner and outer surfaces and at least two ribs on the other of said inner and outer surfaces.

By providing a plurality of ribs on each surface of the spring, and in particular three ribs on one surface and two on the other, allows for the most effective number of ribs to be provided in the limited space available to produce a spring for a clip of a garment hanger.

According to another aspect of the present invention there is provided a garment hanger comprising:— at least one suspension device for suspending the hanger from a support;

a body connected to said suspension device;

at least one clip connected to said body for retaining a garment, the or each clip comprising a pair of clip portions, between which the garment is clamped, and at least one generally U-shaped spring for biasing said clamping portions, wherein at least one said spring comprises a plurality of ribs extending at least partially around the curvature of the U of said spring, wherein the ribs form a sine-wave-like cross-section at said curvature.

According to a further aspect of the present invention there is provided a garment hanger comprising:— at least one suspension device for suspending the hanger from a support;

a body connected to said suspension device;

at least one clip connected to said body for retaining a garment, the or each clip comprising a pair of clip portions, between which the garment is clamped, and at least one generally U-shaped spring for biasing said clamping portions, wherein at least one said spring comprises a plurality of ribs extending at least partially around the curvature of the U of said spring, wherein formation of said ribs causes sides of said spring adjacent said ribs to be drawn inwards.

According to an aspect of the present invention there is provided a spring for use in a garment hanger which includes at least one suspension device for suspending the hanger from a support, a body connected to said suspension device and at least one clip connected to said body for retaining a garment, the or each clip comprising a pair of clip portions, between which the garment is clamped by the spring which comprises:— metal formed into a U-shape; and convex ribs formed into said metal both on the inner and outer services of the curvature of said U of said spring.

According to another aspect of the present invention there is provided a spring for use in a garment hanger which includes at least one suspension device for suspending the hanger from a support, a body connected to said suspension device and at least one clip connected to said body for retaining a garment, the or each clip comprising a pair of clip portions, between which the garment is clamped by the spring which comprises:— metal formed into a U-shape; and a plurality of ribs extending at least partially around the curvature of the U of said spring, wherein the ribs form a sine-wave-like cross-section at said curvature.

According to a further aspect of the present invention there is provided a spring for use in a garment hanger which includes at least one suspension device for suspending the hanger from a support, a body connected to said suspension device and at least one clip connected to said body for retaining a garment, the or each clip comprising a pair of clip portions, between which the garment is clamped by the spring which comprises:— metal formed into a U-shape; and a plurality of ribs extending at least partially around the curvature of the U of said spring, wherein formation of said ribs causes sides of said spring adjacent said ribs to be drawn inwards.

Preferred embodiments of the present invention will now be described, by way of example only, and not and in any limitative sense with reference to the accompanying drawings in which:—

Figure 2:
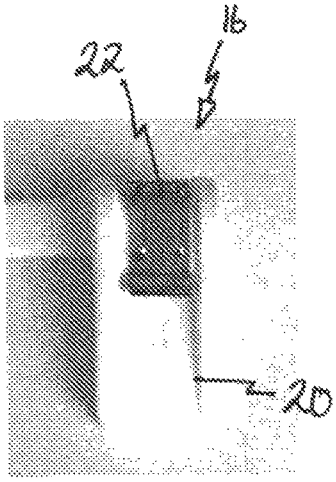
Fig 2. Prior Art
FIGS. 2 to 4 are front views showing a portion of the prior art garment hanger of FIG. 1 and thereby demonstrating the operation of the clips.
Figure 3:
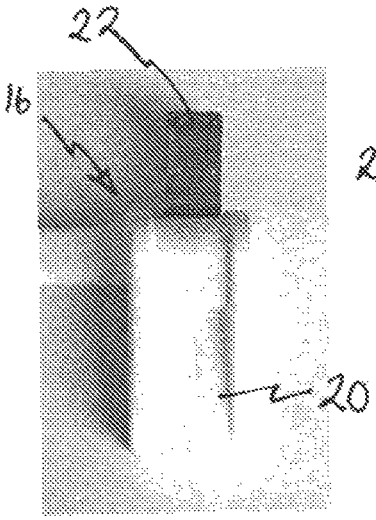
Fig 3. Prior Art
Figure 4:
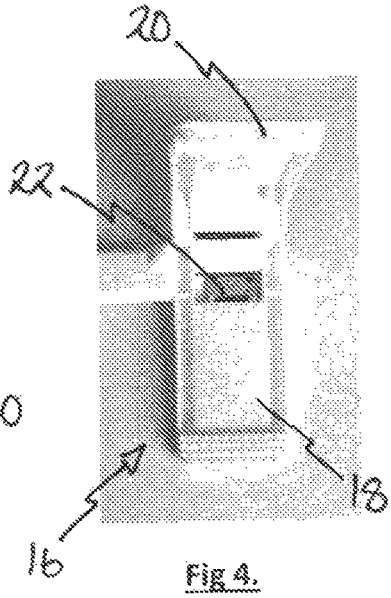
Fig 4. Prior Art
Figure 1:
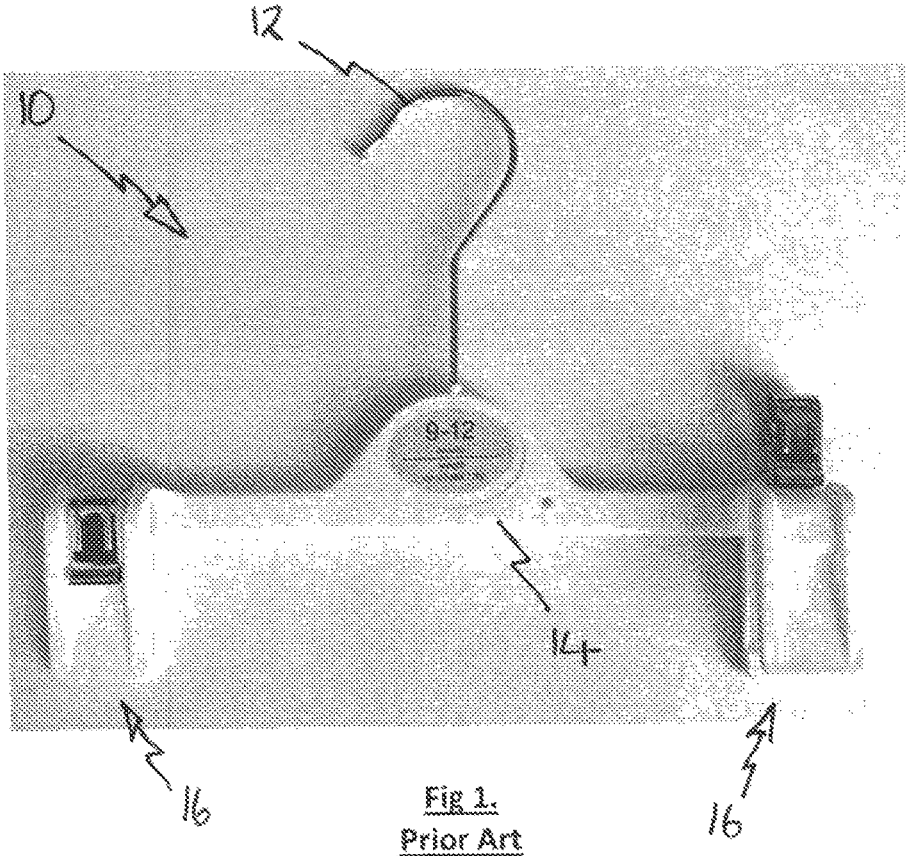
Fig 1. Prior Art
FIG. 1 is a front view of a garment hanger of the prior art.
Figure 5:
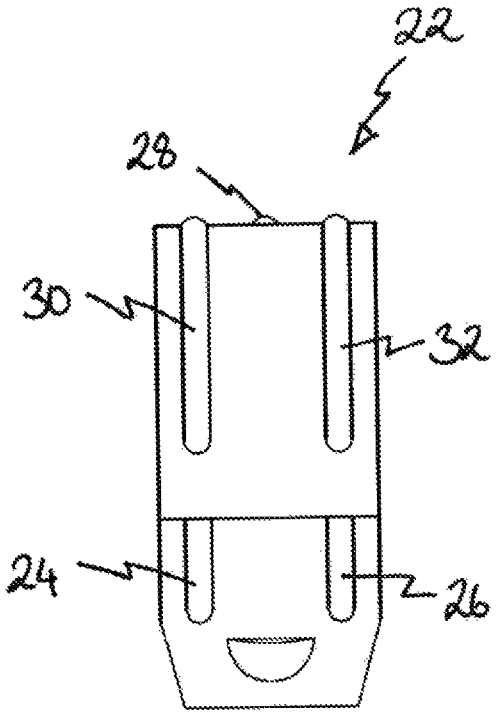
Fig 5. Prior Art
FIGS. 5 to 7 are front, side and top views of a prior art spring used in the clips of FIGS. 2 to 4.

Referring to FIGS. 8 to 12, a spring 40 is provided for use in a hanger of the type previously described in connection with the prior art. The spring 40 replaces the spring 22 as shown in FIGS. 1 to 7 and provides the same function as the spring 22 of the prior art. However, its different construction provides additional biasing force and it can be formed using less material. Images of the use of the spring 40 in conjunction with a garment hanger are not provided and as a result, the reference numerals 10 to 20 are used to describe the parts of the garment hanger 10 that are common to the present invention and the prior art. The hanger 10 includes a suspension device, in the form of hook 12, which is connected to a body 14 of the hanger. Arms extending horizontally from a central portion of body 14, and forming part of the body, terminate in clips 16 which are themselves formed from clip portions 18 and 20. In the embodiment shown in FIGS. 1 to 7 the clip portions 18 and 20 are formed together with the body 14. The clip portions 18 are fixed relative to the body and the clip portions 20 are flexibly connected to the clip portions 18 by live hinges. The present invention can be used with other forms of clips including moveable clips where neither clip portion is formed as part of the body 14 and the clips are able to slide along the body as required. The spring 40 is used to bias the clip portions 18 and 20 into engagement with each other.

The spring 40 is formed by the cutting, stamping and bending of a piece of a sheet of metal, preferably steel, material. In the embodiment shown the sheet steel has a thickness of 0.4 mm (compared to the example of the prior art shown in FIGS. 5 to 7 which has a thickness of 0.45 mm). The spring 40 has a generally U-shaped form which can be seen in FIG. 10 where the spring is arranged in its working condition (when the hanger is hung from a support such as a rail) and has an inverted U-shape. The spring 40 has a first end 42 which is substantially planar except for a notch 44 which is cut into the planar portion 42 and acts as a stop by abutting a bar formed in clip portion 18. This notch and bar are common to both the present invention and the prior art.

Figure 6:
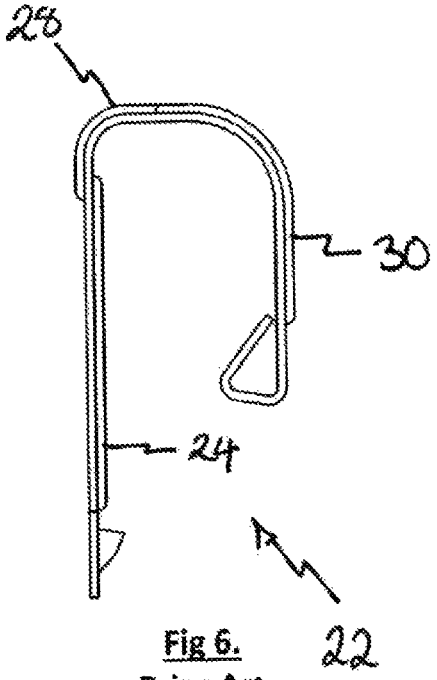
Fig 6. Prior Art
Figure 7:
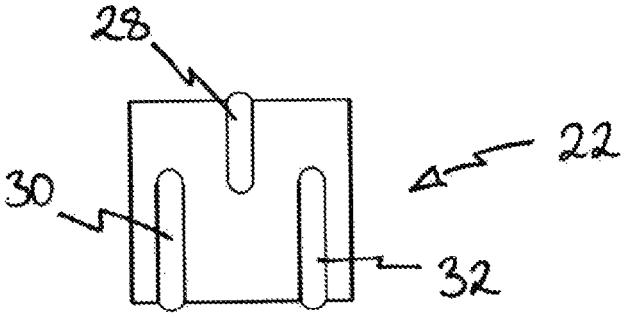
Fig 7. Prior Art
Figure 8:
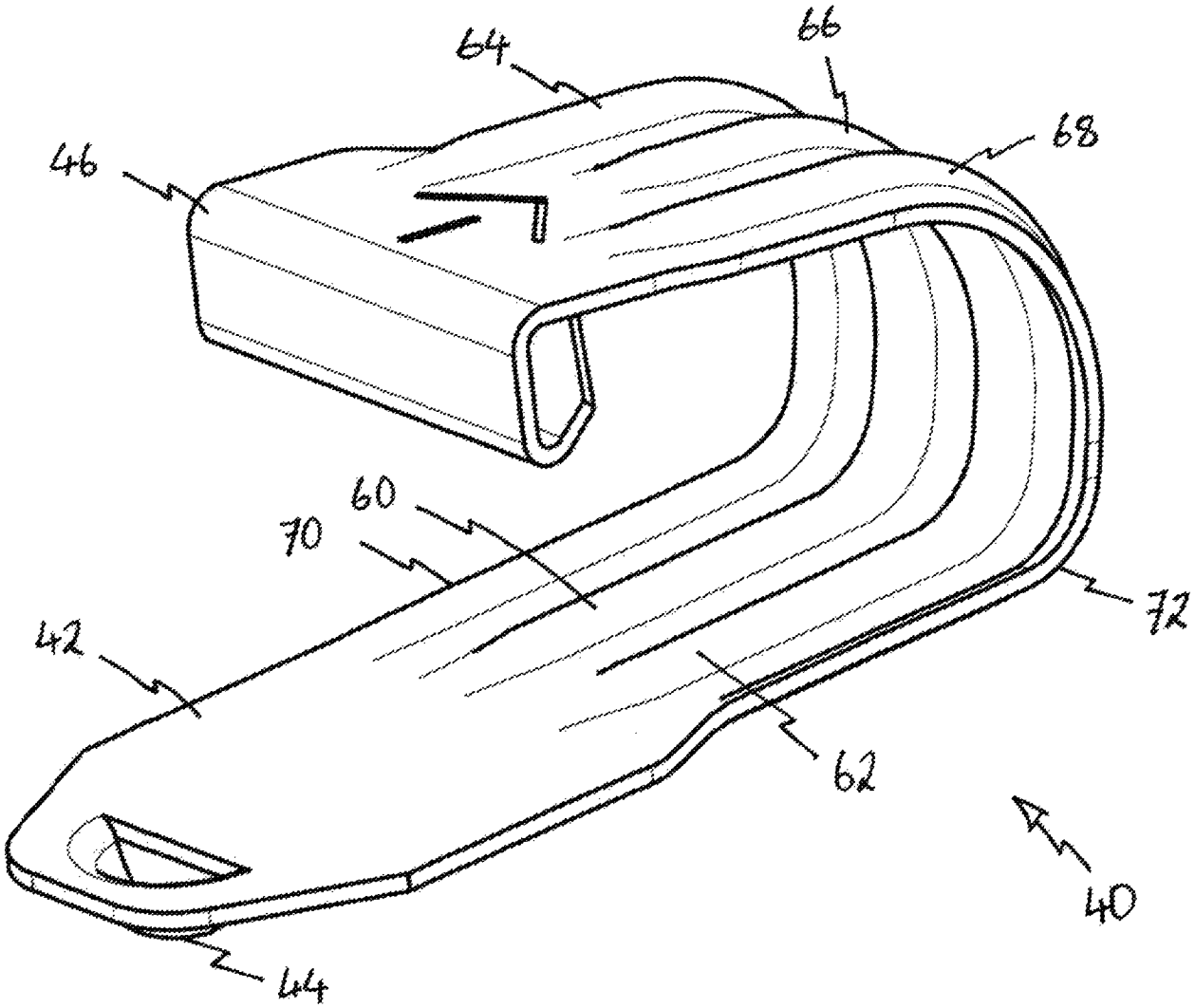
FIG. 8 is a perspective view of a spring for use in a garment hanger of the present invention.
Figure 10:
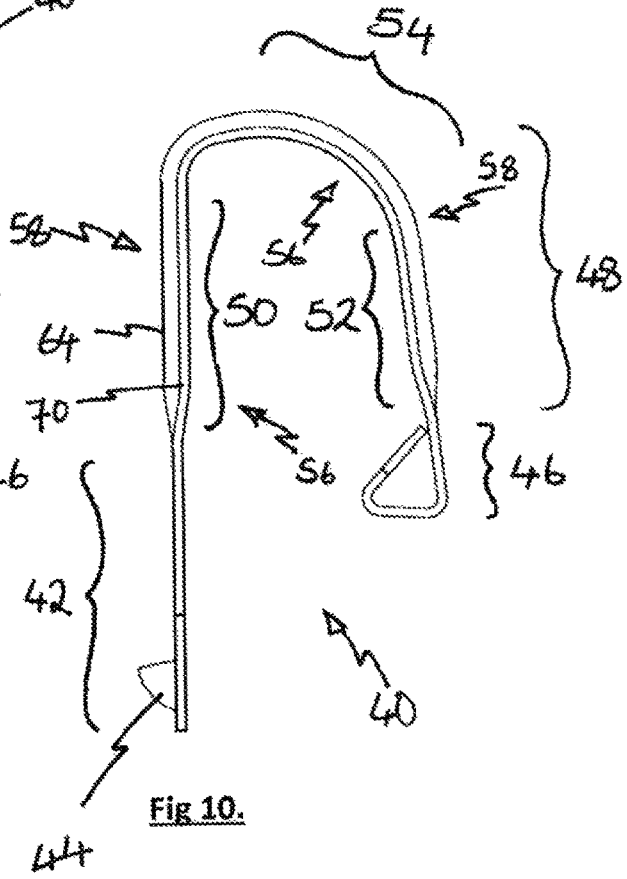

The other or second end 46 of spring 40 is formed by folding the sheet steel back on itself to form a thickened end, this feature also being common to both the present invention and the prior art (see FIGS. 6 and 10). Between the first end 42 and the second end 46 is a ribbed portion 48 which can be subdivided into three further portions including: a first linear portion 50 (which is adjacent the first end 42); a second linear portion 52 (which is adjacent the second end 46); and a curved portion 54 which extends between the two linear portions 50 and 52 and forms the curvature of the U-shape of spring 40. The ribs of ribbed portion 48 are formed along the length of the ribbed portion and extend along the first linear portion 50, continue into the curved portion 54 and continue again into the second linear portion 52. The ribbed portion 48 includes a plurality of ribs formed both on the inside 56 and outside 58 surfaces of the spring 40. For the purposes of illustration, the ribs are defined by their convex outer surface and are labelled 60 and 62 on the inner surface 56 and are labelled 64, 66 and 68 on the outer surface 58. However, the ribs could equally be defined by their inner concave surface. The inner surface 56 also includes two partial ribs 70 and 72 which define the outer long edges of the spring 40 in the ribbed portion 48.

Figure 12:
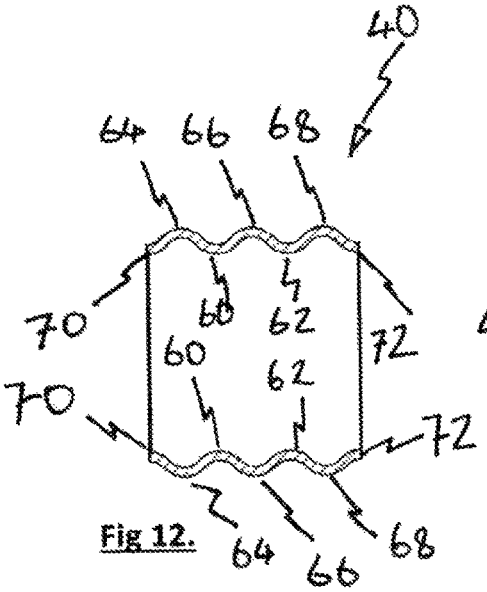
FIG. 12 is a sectional view along the line A-A.
Figure 11:
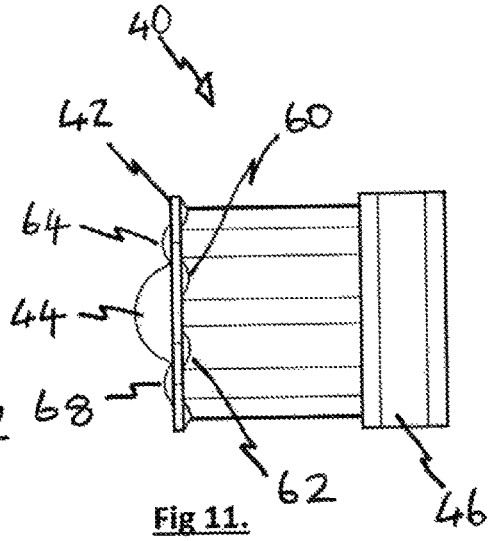
FIGS. 9, 10 and 11 are front, side and underneath views of the spring of FIG. 8.
Figure 9:
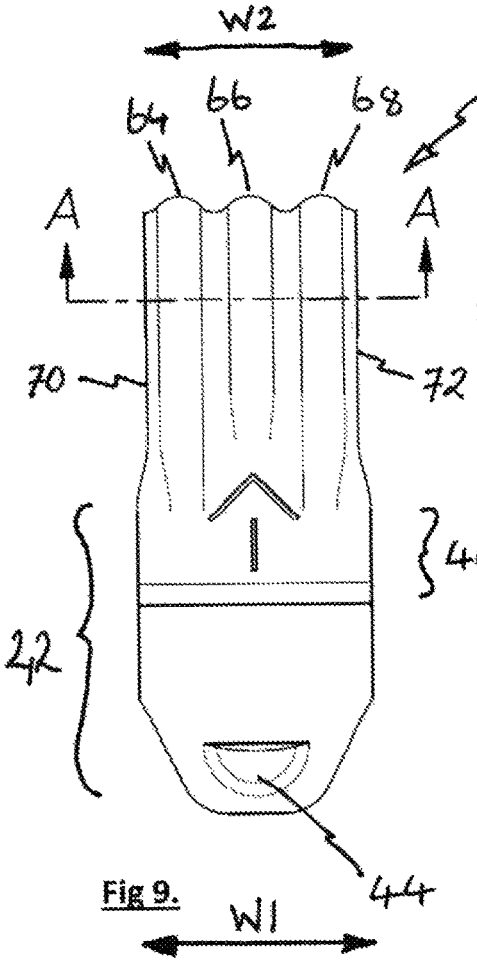

As can be seen most clearly from the cross-sectional view in FIG. 12, the ribs 60 to 68 are arranged such that an external rib (64, 66 or 68) is immediately adjacent an internal rib (60, 62 and partial ribs 70 and 72). As a result, the ribs combine together to provide additional strength. When all of the ribs and partial ribs are arranged sufficiently closely that they flow into each other (that is so that partial ribs 70 on internal surface 56 is adjacent external rib 64, which is adjacent internal rib 60, which is adjacent external rib 66, which is adjacent internal rib 62, which is adjacent external rib 68, which is adjacent partial internal rib 72) a continuous wave like cross-sectional structure, which has a sign-wave-like form, is created.

Because the ribbed portion 48 contains six ribs (five full ribs 60, 62, 64, 66 and 68 plus two part ribs 70 and 72) there is significant movement of the material which forms the spring 40. In order to prevent stretching, and therefore thinning of the thickness of the metal forming the spring, the long edges (indicated by part ribs 70 and 72) are drawn inwards towards each other and there is therefore a narrowing of the width of the spring along the ribbed portion 48. In other words the width of the spring as measured at either the first end 42 or second end 46, and indicated as W1, is greater than the width of the spring as measured at the ribbed portion 48, and indicated at W2.

The spring 40 is formed by the partial cutting of the spring from a sheet of steel. The ribs are formed into the spring by a stamping process. Further cutting of the sheet forms the shape of second end 46 which is then bent into its triangular shape and the curvature of curved portion 54 is then formed. The spring is cut from the remaining material and an annealing process is applied to harden the steel. The spring is then preferably coated and is ready for use in a garment hanger.

It will be appreciated by persons skilled in the art that the above embodiments have been described by way of example only and not in any limitative sense, and that various alterations and modifications are possible without departure from the scope of the protection which is defined by the appended claims. For example, the style of ribbing described above for spring 40 could equally be used for other springs used in garment hangers. For example, these ribs could be used to strengthen the springs in other clip hangers including those that perform a clipping function more like that of a clothes peg where a garment is loaded onto and released from a clip by applying pressure to the ends of the clip that oppose the gripping ends.

The invention claimed is:

1. A garment hanger comprising:

at least one suspension device for suspending the hanger from a support;

a body connected to said suspension device; and at least one clip connected to said body for retaining a garment, the or each clip comprising a pair of clip portions, between which the garment is clamped, and at least one spring having a generally U-shape for biasing said clip portions, wherein at least one said spring comprises convex ribs having a length which extends at least partially around a curvature of said U-shape of said spring, said convex ribs being located on both an inner surface and an outer surface of said spring.

2. A hanger according to claim 1, wherein one of said convex ribs on said inner surface is adjacent one of said convex ribs on said outer surface.

3. A hanger according to claim 1, wherein said convex ribs together form a substantially sine-wave-like cross-section.

4. A hanger according to claim 1, wherein said spring comprises a first end, a second end, and a ribbed portion extending between said first and second ends, said convex ribs being located on said ribbed portion, and wherein at least one of said first and second ends has a first width and said ribbed portion has a second width, said first width being greater than said second width.

5. A hanger according to claim 1, wherein said spring comprises a plurality of said convex ribs on said inner surface and a plurality of said convex ribs on said outer surface.

6. A hanger according to claim 5, wherein said spring comprises at least three of said convex ribs on one of said inner and outer surfaces and at least two of said convex ribs on the other of said inner and outer surfaces.

7. A garment hanger comprising:

at least one suspension device for suspending the hanger from a support;

a body connected to said suspension device;

at least one clip connected to said body for retaining a garment, the or each clip comprising a pair of clip portions, between which the garment is clamped, and at least one generally U-shaped spring for biasing said clip portions, wherein at least one said U-shaped spring comprises a plurality of ribs extending at least partially around a curvature of a U of said spring, wherein the ribs form a sine-wave-like cross-section at said curvature.

8. A garment hanger comprising:

at least one suspension device for suspending the hanger from a support;

a body connected to said suspension device;

at least one clip connected to said body for retaining a garment, the or each clip comprising a pair of clip portions, between which the garment is clamped, and at least one spring having a generally U-shape for biasing said clip portions, wherein at least one said spring comprises an inner surface, an outer surface, and a plurality of convex ribs extending at least partially around a curvature of the U-shape of said spring, wherein at least three of said convex ribs are on one of said inner and outer surfaces and at least two of said ribs are on the other of said inner and outer surfaces with said convex ribs on said inner and outer surfaces being arranged consecutively.

9. The hanger according to claim 1 wherein said spring comprises a first end portion, a second end portion, and a ribbed portion located between said first and second end portions, and wherein said ribbed portion comprises a first linear portion adjacent to said first end portion, a second linear portion adjacent to said second end portion, and a curved portion extending between said first and second linear portions, and wherein each of said convex ribs extends at least partially along each of said first linear portion, said second linear portion and said curved portion of said ribbed portion of said spring.

10. The hanger according to claim 8 wherein each of the at least two of said ribs on the other of said inner and outer surfaces is located between two of the at least three of said convex ribs on the one of said inner and outer surfaces.

11. The hanger according to claim 8 wherein each of said convex ribs on said inner surface of said spring is adjacent to at least one concave portion of said inner surface of said spring and wherein each of said convex ribs on said outer surface of said spring is adjacent to at least one concave portion of said outer surface of said spring.

12. The hanger according to claim 8 wherein said spring comprises a first outer edge and a second outer edge, said inner and outer surfaces extending between said first and second outer edges, and wherein said convex ribs alternate between being located on the one of said inner and outer surfaces and the other of said inner and outer surfaces moving from said first outer edge to said second outer edge.

13. The hanger according to claim 8 wherein said spring comprises a first end portion, a second end portion, and a ribbed portion located between said first and second end portions, and wherein said ribbed portion comprises a first linear portion adjacent to said first end portion, a second linear portion adjacent to said second end portion, and a curved portion extending between said first and second linear portions, and wherein each of said convex ribs extends at least partially along each of said first linear portion, said second linear portion and said curved portion of said ribbed portion of said spring.

* * * * *